US009413096B2

(12) United States Patent
Uchiyama et al.

(10) Patent No.: US 9,413,096 B2
(45) Date of Patent: Aug. 9, 2016

(54) CONNECTOR WITH PLATE-LIKE FUNCTIONAL PORTION

(71) Applicant: Sumitomo Wiring Systems, Ltd., Yokkaichi, Mie (JP)

(72) Inventors: Yoshihiro Uchiyama, Mie (JP); Junya Matsuura, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/637,503

(22) Filed: Mar. 4, 2015

(65) Prior Publication Data

US 2015/0280347 A1 Oct. 1, 2015

(30) Foreign Application Priority Data

Mar. 28, 2014 (JP) ..... 2014-068756

(51) Int. Cl.
*H01R 13/514* (2006.01)
*H01R 13/422* (2006.01)

(52) U.S. Cl.
CPC ..... *H01R 13/4223* (2013.01)

(58) Field of Classification Search
CPC ..... H01R 13/4223; H01R 13/4362
USPC ..... 439/595, 752, 752.5
See application file for complete search history.

(56) References Cited

U.S. PATENT DOCUMENTS 6,682,366 B2 * 1/2004 Tanaka ..... H01R 13/4223 439/595
6,948,978 B2 * 9/2005 Itou ..... H01R 13/4364 439/595
7,044,788 B2 * 5/2006 Maeda ..... H01R 13/4365 439/595
7,112,104 B2 * 9/2006 Sagawa ..... H01R 13/4365 439/595
7,140,915 B2 * 11/2006 Casses ..... H01R 13/4223 439/592
7,252,556 B2 * 8/2007 Anbo ..... H01R 13/4367 439/357
7,281,961 B1 * 10/2007 Sugiyama ..... H01R 13/113 439/595
8,376,778 B2 * 2/2013 Obata ..... H01R 13/4223 439/595
8,388,388 B2 * 3/2013 Suzuki ..... H01R 13/113 439/752.5
8,678,865 B2 * 3/2014 Hiraishi ..... H01R 13/4365 439/595
9,017,111 B2 * 4/2015 Zheng ..... H01R 13/4223 439/595
9,039,462 B2 * 5/2015 Yoon ..... H01R 13/62 439/752

FOREIGN PATENT DOCUMENTS

JP 2005-166608 6/2005

* cited by examiner

*Primary Examiner* — Thanh Tam Le
(74) *Attorney, Agent, or Firm* — Gerald E. Hespos; Michael J. Porco; Matthew T. Hespos

(57) ABSTRACT

A connector (F) includes a housing (10) formed with terminal accommodating chambers (11) in multiple stages in a vertical direction. Locking lances (12) cantilever forward along lower wall surfaces of the terminal accommodating chambers (11), and terminal fittings (30) are retained by the locking lances (12). Deflection spaces (13, 13E) allow the locking lances (12) to be resiliently deflected. Horizontal plate-like functional portions (21, 21E) are formed on a front retainer (20) and are insertable into the deflection spaces (13, 13E). A supporting plate (14) is cantilevered forward along a lower surface of the lowermost plate-like functional portion (21, 21E) and constitutes an outer wall of the housing (10). Reinforcing ribs (15, 15E) and (16) are formed on the supporting plate (14) and are configured to enhance flexural rigidity of the supporting plate (14).

8 Claims, 8 Drawing Sheets

CONNECTOR WITH PLATE-LIKE FUNCTIONAL PORTION

BACKGROUND

1. Field of the Invention

The invention relates to a connector.

2. Description of the Related Art

Japanese Unexamined Patent Publication No. 2005-166608 discloses a connector including a housing formed with cavities in multiple stages in a vertical direction. Locking lances are cantilevered forward along lower surfaces of the respective cavities. Terminal fittings can be inserted into the cavities from behind and are locked by the locking lances. A front retainer is assembled with the housing from the front and horizontal restricting plates formed on the front retainer are inserted into deflection spaces for the locking lances. Insertion of the restricting plates into the deflection spaces for the locking lances restrict deflection of the locking lances away the terminal fittings and reliably retain the terminal fittings.

A lower surface side of the lowermost restricting plats is covered by a supporting plate constituting an outer wall of the housing. The supporting plate is expected to correct a curvature of the restricting plates that occurs when the front retainer is molded. However, the supporting plate is not connected to side walls that partition the cavities in a lateral direction. Thus, the reliability of a correcting function is low.

The invention was completed based on the above situation and aims to reliably correct the deformation of a plate-like functional portion located at an outermost end of a front retainer.

SUMMARY OF THE INVENTION

A connector of the invention includes a housing formed with terminal accommodating chambers in multiple stages in a vertical direction, and locking lances are cantilevered forward along lower wall surfaces of the terminal accommodating chambers. Terminal fittings can be inserted into the terminal accommodating chambers from behind and are retained by being locked by the locking lances. Deflection spaces formed into slits extend laterally at lower surfaces of the locking lances and are configured so that the locking lances can resiliently deflect to separate from the terminal fittings. A front retainer is assembled on a front end of the housing. Horizontal plate-like functional portions are formed on the front retainer and are insertable into the deflection spaces. A supporting plate is cantilevered forward along a lower surface of the lowermost plate-like functional portion and constitutes an outer wall of the housing. At least one reinforcing rib is formed on the supporting plate to enhance flexural rigidity of the supporting plate and to correct curving deformation of the plate-like functional portion.

The reinforcing rib may extend in a front-back direction and plural reinforcing ribs may be spaced apart in the lateral direction. Accordingly, the supporting plate has a straight shape with no height difference between a rear part and a front part when viewed laterally. The plural laterally spaced reinforcing ribs ensure that the supporting plate is kept flat plate over the entire area in the lateral direction thereof.

Reinforcing ribs may be provided on upper and lower surfaces of the supporting plate, and the reinforcing ribs on an upper surface may be offset laterally from the reinforcing ribs on a lower surface. Thus, flexural rigidity of the supporting plate can be enhanced stably and reliably.

The reinforcing ribs may be arranged on opposite left and right ends of an upper surface of the supporting plate portion and may connect opposite left and right side walls of the housing and opposite left and right ends of the supporting plate. Thus, flexural rigidity of the opposite left and right ends of the supporting plate can be enhanced more reliably.

The front retainer may be mounted and removed by being moved in a front-back direction with respect to the housing. The reinforcing rib may extend in the front-back direction on an upper surface of the supporting plate portion, and the plate-like functional portion at the lowermost end may be formed with a groove in a lower surface that can slide in contact with the reinforcing rib. Thus, a function of guiding the front retainer is exhibited by the sliding contact of the reinforcing rib and the groove when assembling the front retainer with the housing.

The groove may be formed by recessing only the lower surface of the plate-like functional portion at the lowermost end. Thus, the plate-like functional portion can remain strong.

DETAILED DESCRIPTION

Figure 1:
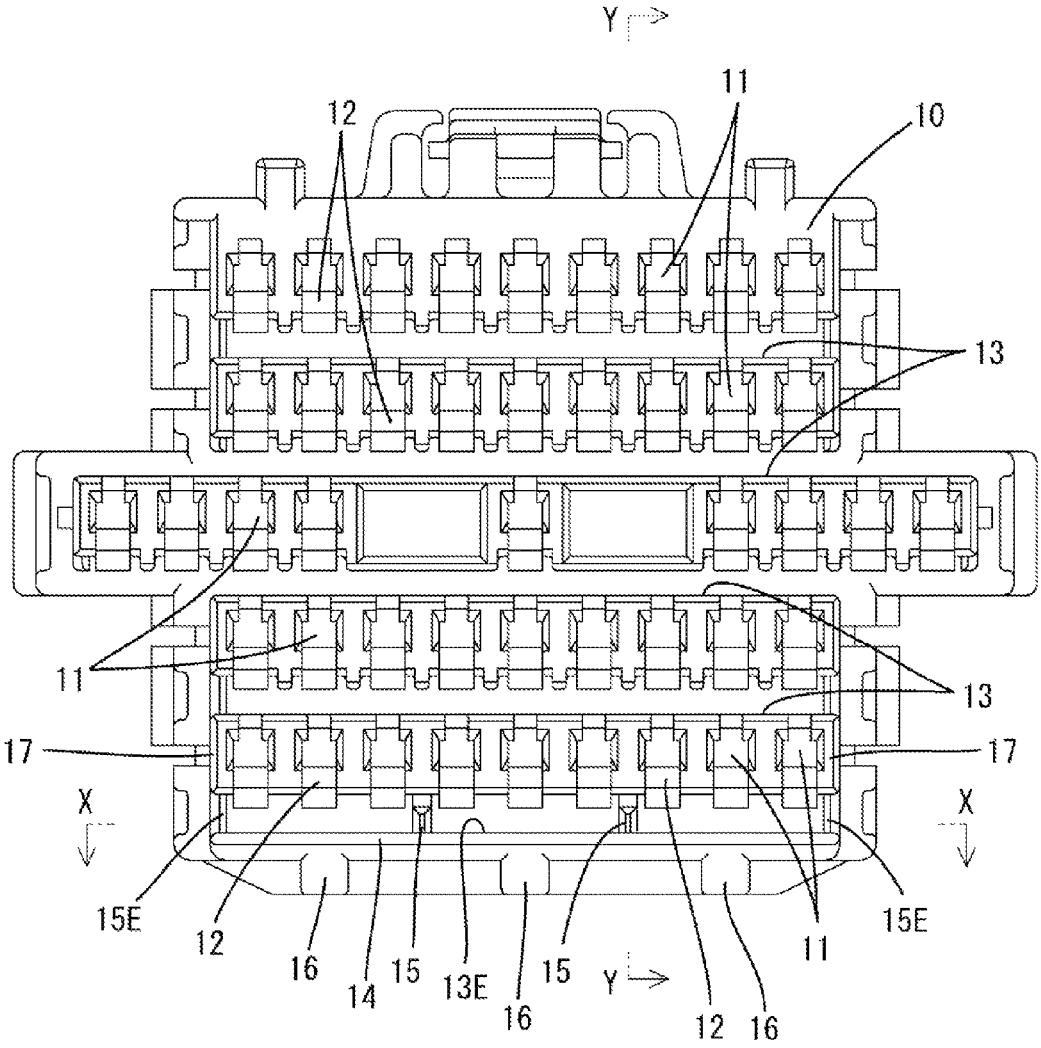
FIG. 1 is a front view of a housing constituting a connector of an embodiment.
Figure 3:
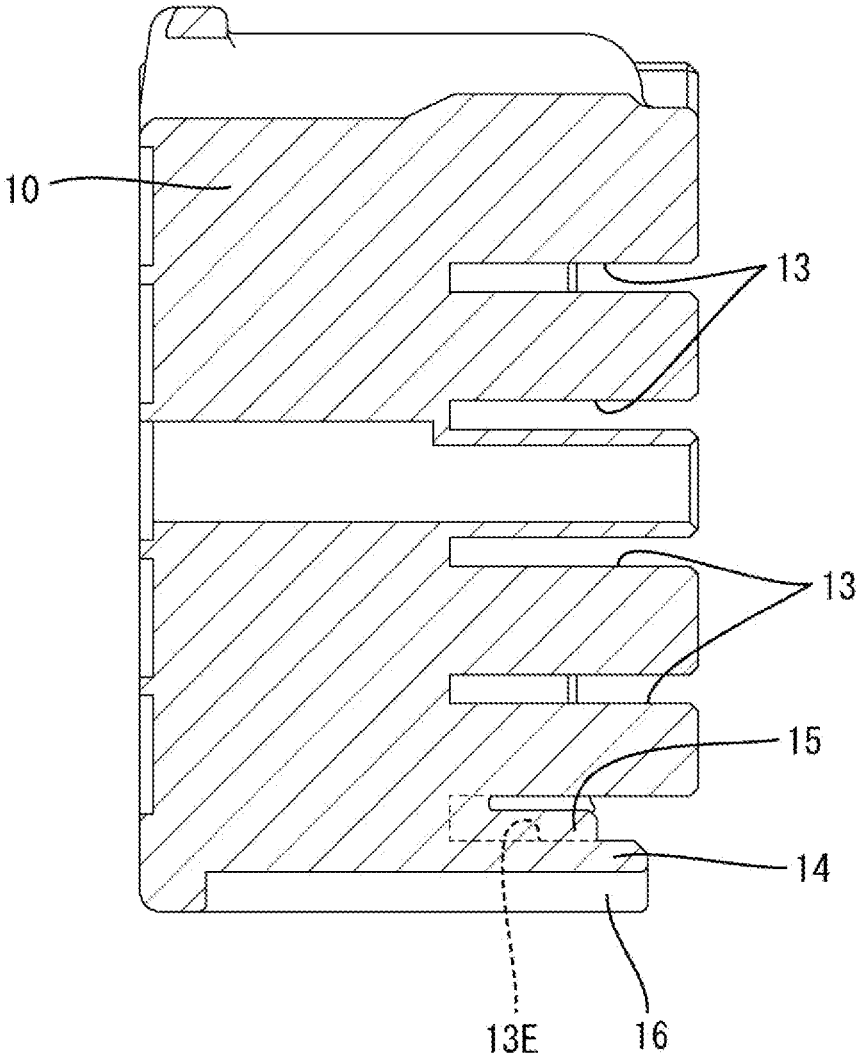
FIG. 3 is a section along a line Y-Y of FIG. 1.
Figure 4:
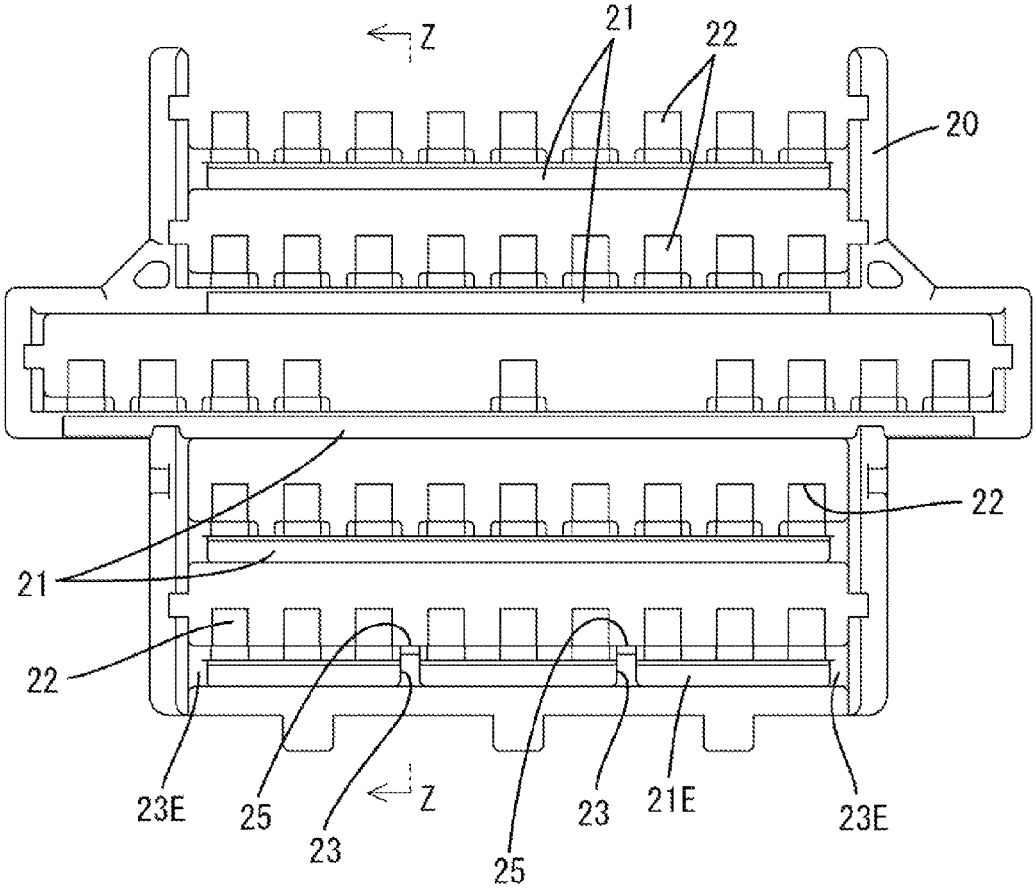
FIG. 4 is a rear view of a front retainer.
Figure 5:
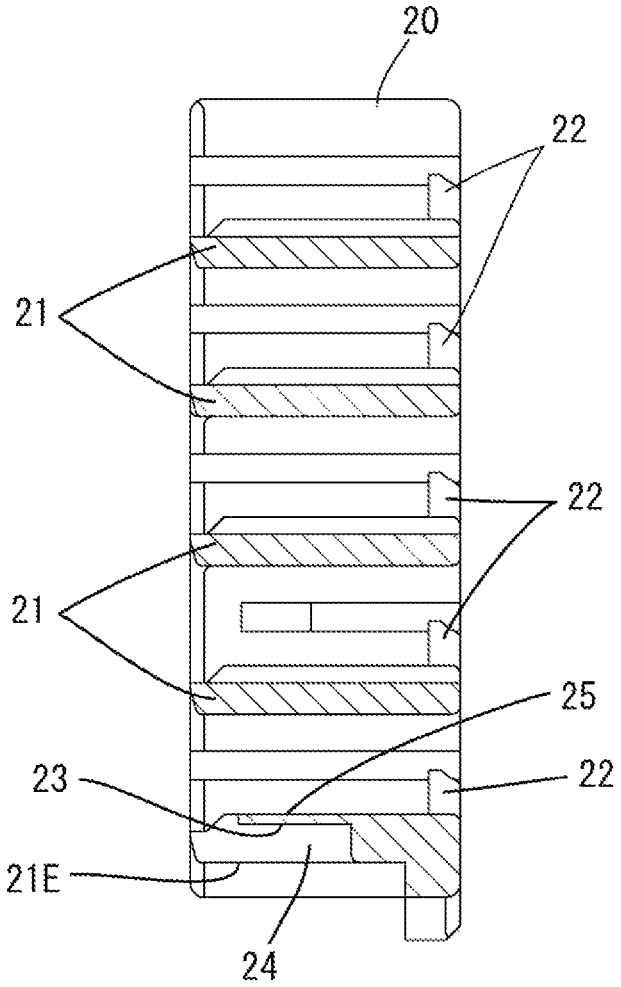
FIG. 5 is a section along a line Z-Z of FIG. 4.
Figure 6:
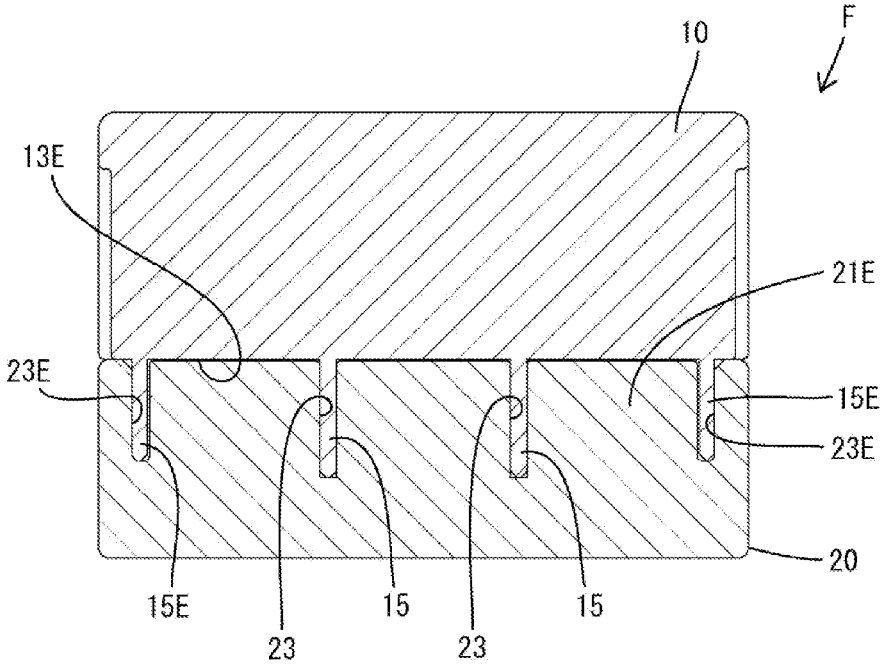
FIG. 6 is a section along a line corresponding to the line X-X of FIG. 1 showing a state where the front retainer is assembled with the housing.
Figure 7:
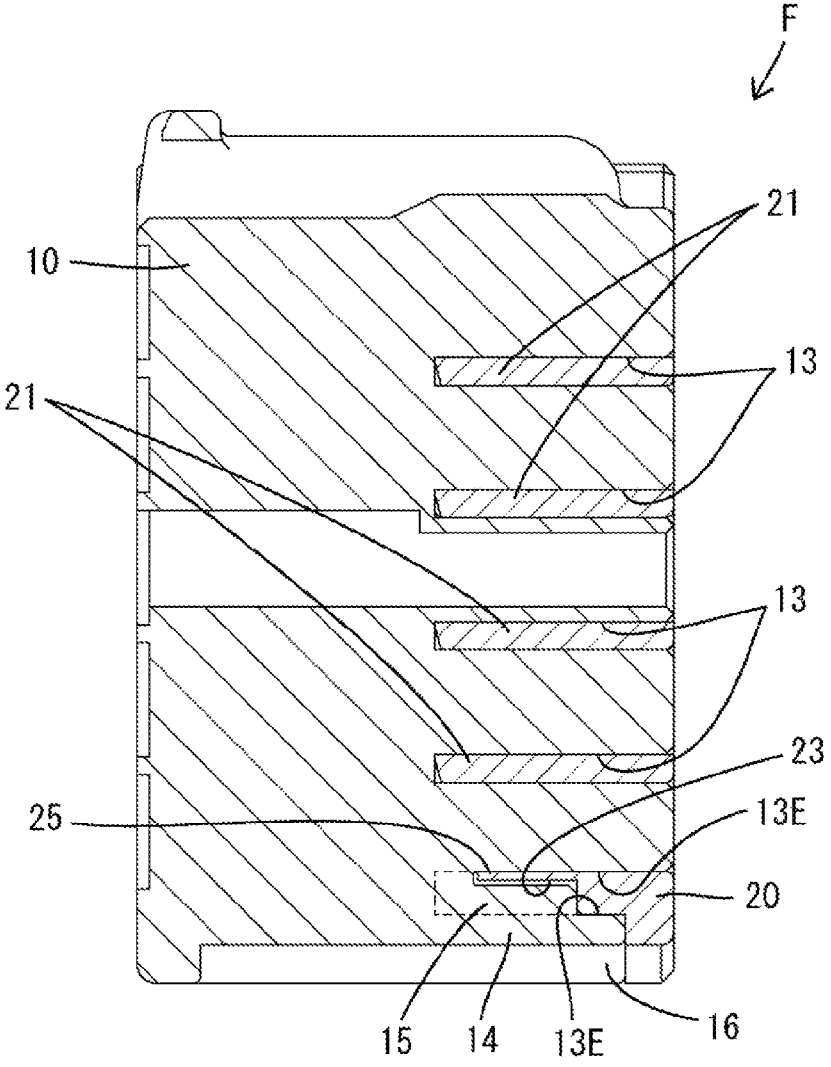
FIG. 7 is a section along a line corresponding to the line Y-Y of FIG. 1 showing the state where the front retainer is assembled with the housing.

An embodiment of the invention is described with reference to FIGS. 1 to 8. A right side in FIGS. 3, 5 and 7 is defined as a front end concerning a front-back direction. Upper and lower sides in FIGS. 1 and 3 to 5 are defined as upper and lower sides concerning a vertical direction. A lateral direction in FIGS. 1 and 4 is defined as the lateral direction.

A female connector F of this embodiment is formed by assembling a housing 10 made of synthetic resin, a front retainer 20 made of synthetic resin and a plurality of terminal fittings 30.

Figure 8:
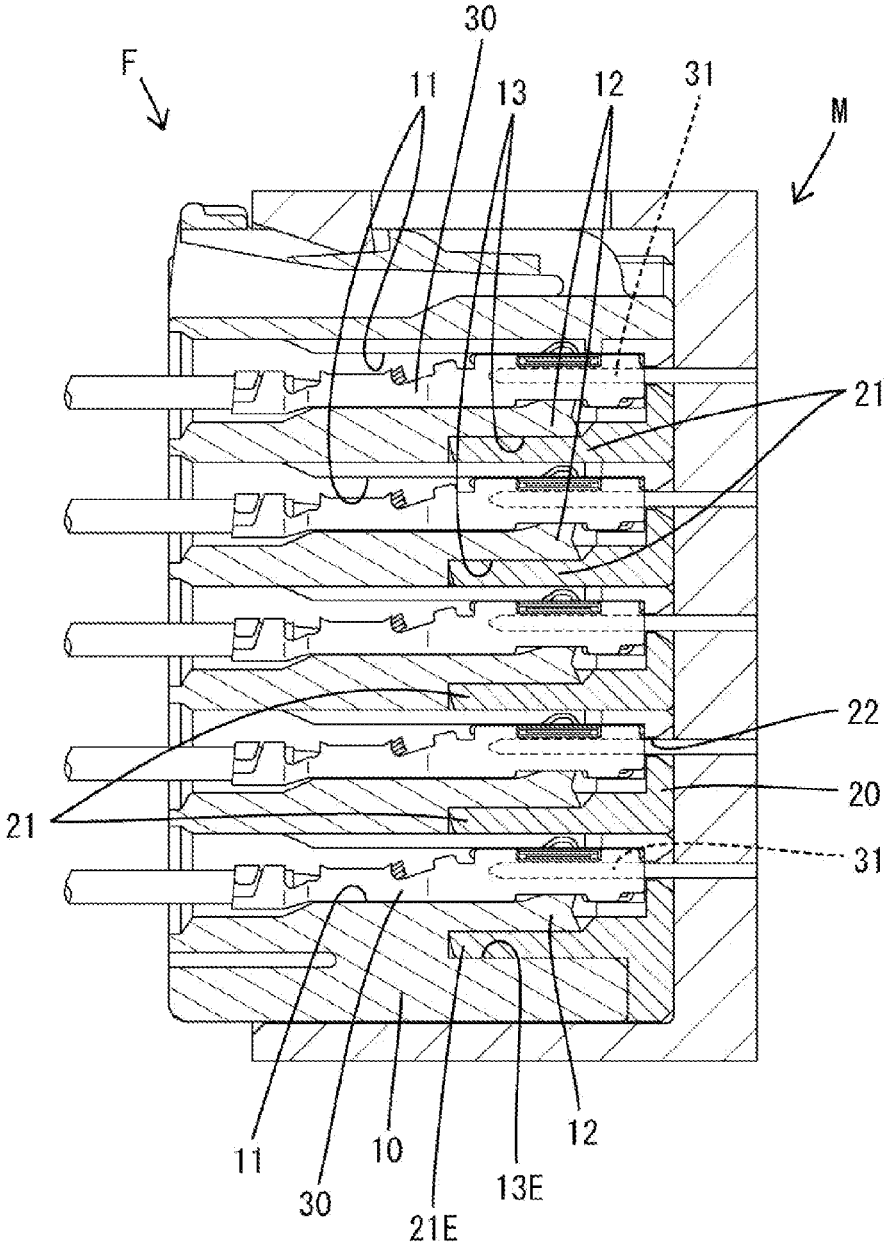
FIG. 8 is a side view in section showing a state where a female connector and a male connector are connected.

As shown in FIGS. 1 and 8, terminal accommodating chambers 11 penetrate the housing 10 in the front-back direction and are formed in multiple stages in the vertical direction. The terminal accommodating chambers 11 in each stage are arranged side by side at predetermined intervals in the lateral direction. As shown in FIG. 8, a locking lance 12 is cantilevered forward along a lower surface of each terminal accommodating chamber 11. The terminal fitting 30 is inserted into each terminal accommodating chamber 11 from behind. The locking lance 12 interferes with the terminal fitting 30 during the inserting process and deflects resiliently down to retract from an insertion path for the terminal fitting 30. The locking lance 12 resiliently restores to lock the terminal fitting 30 when the terminal fitting 30 reaches a proper insertion position. Thus, the properly inserted terminal fitting 30 is retained in the terminal accommodating chamber 11.

As shown in FIGS. 1 and 8, deflection spaces 13, 13E are formed below the locking lances 12 and allow the locking lances 12 to deflect resiliently down. The deflection spaces 13, 13E are open on the front surface of the housing 10 and define slits that extend in the lateral direction (horizontal direction) in each stage. A plurality of locking lances 12 face one deflection space 13, 13E from above while being juxtaposed in the lateral direction. The locking lances 12 can be deflected resiliently to enter the deflection space 13, 13E.

As shown in FIGS. 1 and 3, a supporting plate 14 extends in the lateral direction and cantilevers unitarily forward at a lower end part of the housing 10. The supporting plate 14 is arranged at a front part of the housing 10 and constitutes a front end part of a bottom wall of the housing 10. The supporting plate 14 constitutes a lower surface of the lowermost deflection space 13E. Formation areas of the supporting plate 14 and the lowermost deflection space 13E in the lateral direction correspond (match).

The front retainer 20 is assembled with the housing 10 from the front. As shown in FIG. 4, the front retainer 20 includes plate-like functional portions 21, 21E extending in the lateral direction and juxtaposed in multiple stages while being spaced apart in the vertical direction. Front stops 22 are formed on the upper surface of each plate-like functional portion 21, 21E at positions corresponding to the respective terminal accommodating chambers 11 for stopping the terminal fittings 30 inserted into the terminal accommodating chamber 11. As shown in FIG. 8, spaces are defined above the front stops 22 for allowing male terminals 31 to be inserted into the terminal accommodating chambers 11 when the female connector F is connected to a male connector M.

The plate-like functional portions 21, 21E are arranged in multiple stages in the vertical direction to be inserted individually into the deflection spaces 13, 13E formed in multiple stages. Deflection of the locking lances 12 away from the terminal fittings 30 (i.e. into the deflection spaces 13, 13E) is restricted when the plate-like functional portions 21, 21E enter the deflection spaces 13, 13E and hence the locking lances 12 are held locked to the terminal fittings 30. In this way, the terminal fittings 30 retained reliably by the locking action of the locking lances 12.

Further, the locking lance 12 for any incompletely inserted terminal fitting 30 remains in the deflection space 13, 13E. The plate-like functional portion 21, 21E collides with any locking lance 12 remaining in the deflection space 13, 13E and prevents full assembly of the front retainer 20, indicating the presence of an incompletely inserted terminal fitting 30. Thus, the plate-like functional portions 21, 21E have a function of reliably retaining the terminal fittings 30 and a function of detecting the presence of the incompletely inserted terminal fitting 30.

The supporting plate 14 that forms the outer wall of the housing 10 covers lower surface of the lowermost plate-like functional portion 21E when the front retainer 20 is assembled with the housing 10, as shown in FIG. 7. This supporting plate 14 has a function of correcting the curvature of the lowermost plate-like functional portion 21E when the plate-like functional portion 21E is curved and deformed to bulge out downward in the process of molding the front retainer 20. However, this supporting plate 14 is not connected to partition walls between laterally adjacent terminal accommodating chambers 11. Hence, there is a possibility of deformation and an unreliable correcting function.

Figure 2:
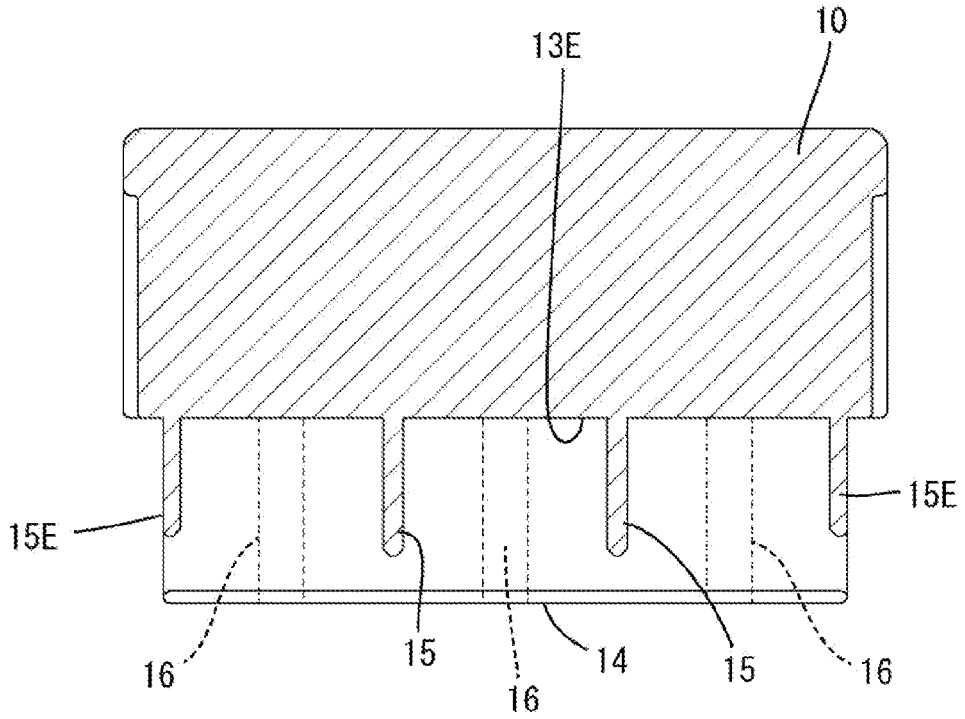
FIG. 2 is a section along a line X-X of FIG. 1.

Accordingly, four upper reinforcing ribs 15, 15E are formed unitarily on the upper surface of the supporting plate 14 and three lower reinforcing ribs 16 are formed unitarily on the lower surface of the supporting plate 14 as shown in FIGS. 1 and 2 to enhance flexural rigidity of the supporting plate 14. The upper reinforcing ribs 15, 15E are in the deflection space 13E at the lowermost end. The lower reinforcing ribs 16 are exposed on an outer surface of the housing 10.

As shown in FIG. 2, the four upper reinforcing ribs 15, 15E extend straight in the front-back direction, i.e. a direction parallel to a direction of assembling the front retainer 20 with the housing 10. A formation area of the four upper reinforcing ribs 15, 15E in the front-back direction is a range from the rear end of the supporting plate 14 to a position slightly behind the front extending end of the supporting plate 14. As shown in FIGS. 1 and 2, the four upper reinforcing ribs 15, 15E are spaced at equal intervals in the lateral direction (i.e. direction perpendicular to a length direction of the upper reinforcing ribs 15, 15E) and are bilaterally symmetrical when viewed from the front. The upper reinforcing ribs 15E on opposite left and right ends connect to the lower end edges of opposite left and right side walls 17 of the housing 10 and opposite left and right end parts of the supporting plate 14 located below them.

As shown in FIG. 2, the three lower reinforcing ribs 16 also extend straight in the front-back direction, similar to the upper reinforcing ribs 15, 15E. A formation area of the three lower reinforcing ribs 16 in the front-back direction is a range from a position farther behind the rear end of the supporting plate 14 (i.e. rear end position of the housing 10) to the front extending end of the supporting plate 14, as shown in FIG. 3. As shown in FIGS. 1 and 2, the three lower reinforcing ribs 16 are spaced at equal intervals in the lateral direction and are bilaterally symmetrical when viewed from the front. The lower reinforcing rib 16 located in the center is arranged at a lateral center position of the supporting plate 14 (housing 10).

The four upper reinforcing ribs 15, 15E are arranged to equally divide the supporting plate 14 into three in the lateral direction and the three lower reinforcing ribs 16 are arranged to be located substantially in the center between adjacent upper reinforcing ribs 15, 15E in the lateral direction. Accordingly, the four upper reinforcing ribs 15, 15E and the three lower reinforcing ribs 16 are arranged vertically alternately (offset) in the lateral direction. These upper reinforcing ribs 15, 15E and lower reinforcing ribs 16 enhance the rigidity of the supporting plate 14 at seven different positions in the lateral direction.

On the other hand, in the front retainer 20, four grooves 23, 23E are formed on the lowermost plate-like functional portion 21E for avoiding interference with the upper reinforcing ribs 15, 15E. As shown in FIGS. 4 to 6, the four grooves 23, 23E are formed by recessing the lower surface of the lowermost plate-like functional portion 21E and extend straight along the front-back direction. The rear ends of the four grooves 23, 23E are exposed to outside on the rear end surface (extending end surface) of the plate-like functional portion 21E.

Two grooves 23E on opposite left and right ends are fit to the upper reinforcing ribs 15E connecting the opposite left and right end parts of the supporting plate 14 and lower end parts of the side walls 17. Thus, these two grooves 23E on the opposite left and right ends penetrate from the lower surface to the upper surface of the plate-like functional portion 21E, as shown in FIG. 4.

Two grooves 23 near the center are formed to fit to the two upper reinforcing ribs 15 located near the center. As shown in FIG. 5, only rear end parts (parts corresponding to the extending end part of the plate-like functional portion 21E) of these two grooves 23 near the center are exposed to the upper surface of the plate-like functional portion 21E. Most areas of the grooves 23 near the center excluding the rear end parts serve as unexposed areas 24 not exposed to upper surface of the plate-like functional portion 21E. Upper edges of opposite left and right inner surfaces of the groove 23 in the unexposed area 24 of this groove 23 are coupled by a horizontal plate-like reinforcing plate 25. That is, the upper surface of the unexposed area 24 is closed by the reinforcing plate 25.

As described above, the female connector F includes the housing 10 formed with the terminal accommodating chambers 11 in multiple stages in the vertical direction, the locking lances 12 cantilevered forward along the lower surfaces of the terminal accommodating chambers 11, the terminal fittings 30 to be inserted into the terminal accommodating chambers 11 from behind and retained by the locking lances 12, and the deflection spaces 13, 13E formed into slits extending in the lateral direction at the lower surface sides of the locking lances 12 and configured to allow the locking lances 12 to deflect resiliently to separate from the terminal fittings 30.

The front retainer 20 is assembled on the front of the housing 10 and is formed with the plurality of horizontal plate-like functional portions 21, 21E insertable into the deflection spaces 13, 13E. The housing 10 includes the supporting plate 14 cantilevered forward along the lower surface of the lowermost plate-like functional portion 21E and constituting a bottom wall portion (outer wall) of the housing 10.

This supporting plate 14 functions to correct curving deformation when the lowermost plate-like functional portion 21E is curved and deformed to bulge out downward in molding the front retainer 20. To enhance the reliability of this correcting function, the supporting plate 14 is formed unitarily with the upper reinforcing ribs 15, 15E and the lower reinforcing ribs 16 for enhancing flexural rigidity of the supporting plate 14. Since flexural rigidity of the supporting plate 14 is enhanced by these upper reinforcing ribs 15, 15E and lower reinforcing ribs 16, curving deformation of the plate-like functional portion 21E at the lowermost end can be corrected reliably.

Further, the upper reinforcing ribs 15, 15E and the lower reinforcing ribs 16 extend in the front-back direction and are at positions spaced apart in the lateral direction. By forming the reinforcing ribs 15, 15E and 16 to extend in the front-back direction in this way, the supporting plate portion 14 maintains a straight shape having no height difference between the rear and front ends when viewed laterally. Since the reinforcing ribs 15, 15E and 16 are arranged at the positions spaced apart in the lateral direction, the supporting plate 14 is kept flat over substantially the entire area in the lateral direction thereof. In addition, since the four upper reinforcing ribs 15, 15E and the three lower reinforcing ribs 16 are arranged alternately in the lateral direction, flexural rigidity of the supporting plate portion 14 can be enhanced more stably and reliably.

The two upper reinforcing ribs 15E on the opposite left and right ends are arranged on the opposite left and right end parts of the upper surface of the supporting plate 14 and connect the opposite left and right side walls 17 of the housing 10 and the opposite left and right end parts of the supporting plate 14. In this way, flexural rigidity of the opposite left and right end parts of the supporting plate portion 14 is enhanced.

Further, the front retainer 20 is mounted and removed by being moved in the front-back direction with respect to the housing 10. The upper reinforcing ribs 15, 15E are formed to extend in the front-back direction on the upper surface of the supporting plate 14. The lowermost plate-like functional portion 21E is formed with the grooves 23, 23E that can slide in contact with the upper reinforcing ribs 15, 15E. Accordingly, in assembling the front retainer 20 with the housing 10, a function of guiding the front retainer 20 is exhibited by the sliding contact of the upper reinforcing ribs 15, 15E and the grooves 23, 23E. Further, since at least parts of the two grooves 23 near the center serve as the unexposed areas 24 formed by recessing only the lower surface of the lowermost plate-like functional portion 21E, a reduction in the strength of the plate-like functional portion 21E is avoided.

The invention is not limited to the above described and illustrated embodiment. For example, the following embodiments are also included in the scope of the invention.

Although the reinforcing ribs are provided on both the upper and lower surfaces of the supporting plate in the above embodiment, they may be provided on either the upper or lower surface of the supporting plate.

Although the four upper reinforcing ribs are provided on the upper surface of the supporting plate in the above embodiment, the number of the upper reinforcing ribs may be three or less or five or more.

Although the three lower reinforcing ribs are provided on the lower surface of the supporting plate in the above embodiment, the number of the lower reinforcing ribs may be two or less or four or more.

Although the upper reinforcing ribs and the lower reinforcing ribs are arranged alternately in the lateral direction (i.e. offset) in the above embodiment, the upper reinforcing ribs and the lower reinforcing ribs may be arranged at the same positions in the lateral direction.

Although the number of the formed upper and lower reinforcing ribs differ in the above embodiment, equal numbers lower and upper reinforcing ribs may be formed.

Although the reinforcing ribs extend in the front-back direction in the above embodiment, the upper and/or lower reinforcing ribs may extend in the lateral direction.

Although the grooves are formed only in the lower surface of the lowermost plate-like functional portion in the above embodiment, they may penetrate from the lower surface to the upper surface of the lowermost plate-like functional portion.

Although the groove portions that slide in contact with the upper reinforcing ribs are formed on the lowermost plate-like functional portion, such grooves may not be formed.

LIST OF REFERENCE SIGNS

F . . . female connector (connector)
10 . . . housing
11 . . . terminal accommodating chamber
12 . . . locking lance
13, 13E . . . deflection space
14 . . . supporting plate portion
15, 15E . . . upper-surface side reinforcing rib (reinforcing rib)
16 . . . lower-surface side reinforcing rib (reinforcing rib)
17 . . . side wall portion
20 . . . front retainer
21 . . . plate-like functional portion
21E . . . plate-like functional portion at lowermost end
23, 23E . . . groove
30 . . . terminal fitting
31 . . . male terminal

What is claimed is:

1. A connector, comprising:

a housing formed with terminal accommodating chambers in multiple stages in a vertical direction;

locking lances cantilevered forward along lower wall surfaces of the terminal accommodating chambers;

terminal fittings to be inserted into the terminal accommodating chambers from behind and retained by being locked by the locking lances;

deflection spaces formed into slits extending in a lateral direction at lower sides of the locking lances and configured to allow the locking lances to deflect resiliently to separate from the terminal fittings;

a front retainer to be assembled on a front end of the housing;

horizontal plate-like functional portions formed on the front retainer and insertable into the deflection spaces;

a supporting plate cantilevered forward from the housing and covering a lower surface of a lowermost one of the plate-like functional portions, the supporting plate constituting an outer wall of the housing; and at least one reinforcing rib formed on the supporting plate and configured to enhance flexural rigidity of the supporting plate.

2. The connector of claim 1, wherein the reinforcing rib extends in a front-back direction.

3. The connector of claim 2, wherein plural reinforcing ribs are provided and are at a plurality of positions spaced apart in a lateral direction.

4. The connector of claim 3, wherein:

the reinforcing ribs are provided on each of upper and lower surfaces of the supporting plate.

5. The connector of claim 4 wherein the reinforcing ribs an upper surface of the supporting plate are offset laterally from the reinforcing ribs on the lower surface of the supporting plate.

6. The connector of claim 4, wherein the reinforcing ribs on opposite left and right end parts of the upper surface of the supporting plate connect to opposite left and right side walls of the housing and opposite left and right ends of the supporting plate.

7. The connector of claim 1, wherein:

the front retainer is mounted and removed by being moved in a front-back direction with respect to the housing;

the reinforcing rib extends in the front-back direction on an upper surface of the supporting plate; and the plate-like functional portion at a lowermost end is formed with a groove formed by recessing a lower surface thereof and capable of sliding in contact with the reinforcing rib.

8. The connector of claim 7, wherein at least a part of the groove is formed by recessing only the lower surface of the plate-like functional portion at the lowermost end.

* * * * *